US007108157B2

(12) United States Patent
Alei

(10) Patent No.: US 7,108,157 B2
(45) Date of Patent: Sep. 19, 2006

(54) LIQUID DISPENSING VALVE ASSEMBLY HAVING A UNITARILY FORMED BASE AND A VACUUM RELEASE FEATURE

(76) Inventor: Philip E. Alei, 7920 Via Ensenada, Carlsbad, CA (US) 92009

( * ) Notice: Subject to any disclaimer, the term of this patent is extended or adjusted under 35 U.S.C. 154(b) by 307 days.

(21) Appl. No.: 10/683,826

(22) Filed: Oct. 10, 2003

(65) Prior Publication Data

US 2005/0077323 A1 Apr. 14, 2005

(51) Int. Cl.
*B67B 5/00* (2006.01)
*B67D 3/00* (2006.01)

(52) U.S. Cl. ..... 222/153.06; 222/481.5; 222/525

(58) Field of Classification Search ..... 222/153.05, 222/153.06, 212, 481.5, 522, 523, 524, 525
See application file for complete search history.

(56) References Cited

U.S. PATENT DOCUMENTS 3,107,829 A * 10/1963 Makowski ..... 222/525
5,005,737 A 4/1991 Rohr
5,048,705 A 9/1991 Lynd et al.
5,079,013 A 1/1992 Belanger
5,122,272 A 6/1992 Iana et al.
5,301,858 A 4/1994 Hollander
5,560,522 A * 10/1996 Clark ..... 222/481.5
5,601,217 A * 2/1997 Wagner ..... 222/481.5
5,651,471 A 7/1997 Green
5,688,397 A 11/1997 Malmborg
5,706,973 A 1/1998 Robbins et al.
5,988,448 A 11/1999 Foth
6,012,596 A 1/2000 Oglesbee et al.
6,079,589 A 6/2000 Matsuyama et al.
6,169,035 B1 1/2001 Liu et al.
6,227,419 B1 * 5/2001 Raboin ..... 222/484
6,250,503 B1 6/2001 Dark
6,305,575 B1 * 10/2001 Wrigley ..... 222/83
6,367,521 B1 4/2002 Dyer et al.

* cited by examiner

*Primary Examiner*—Joseph A. Kaufman
(74) *Attorney, Agent, or Firm*—Stetina Brunda Garred & Brucker

(57) ABSTRACT

A liquid dispensing valve assembly is provided with a vacuum release feature. The valve assembly is adapted to be fastened to a container opening. The assembly includes a unitarily formed one-piece cylindrical base having a vertical center axis. The base a mounting collar; an enclosure portion connected to the mounting collar forming an inner cavity within the base; a spout connected to the enclosure portion having an interconnected axial core substantially positioned within the spout forming an annular liquid passageway; and a gas passageway having at least one inlet orifice located on an outer surface of the spout, the gas passageway including at least one generally horizontally oriented radial pipe section having one end connected to the at least one inlet orifice and another end connecting to a vertically configured pipe section having an exit orifice. The valve assembly may further include a cap having a drain port, wherein the cap adapted to slip fit over the spout.

22 Claims, 4 Drawing Sheets

LIQUID DISPENSING VALVE ASSEMBLY HAVING A UNITARILY FORMED BASE AND A VACUUM RELEASE FEATURE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

1. Field of the Invention

The present invention is related to a liquid dispensing valve for a bottle or container. In particular, the present invention relates to a liquid dispensing valve assembly that has a vacuum release feature which prevents a vacuum from forming when liquid is being dispensed from the container or bottle. Furthermore, the present invention relates to dispensing valves adapted to be installed onto hermetically sealed containers.

2. Background of the Invention

When liquid is dispensed from a plastic container or bottle, such as a squeezable water bottle, sports drink bottle, or a bicycle bottle, it is not uncommon for a vacuum to form within the bottle. As a result of the vacuum buildup, flow of the liquid out from the spout and valve assembly of the bottle is typically inhibited. Eventually, the vacuum may even prevent the liquid from exiting from the bottle. To correct this phenomena, usually the bottle cap must be cracked open by the consumer to relieve the vacuum buildup so that air can re-enter the bottle and provide sufficient back pressure to re-establish flow. This phenomena can become annoying to the consumer of the product.

There are numerous liquid dispensing valve assemblies available for containers which have solved the vacuum build-up problem; however, while these products are functional, there still are numerous disadvantages affiliated with each design. All of the prior art examples utilize designs having several parts, resulting in costly manufacturing and assembly processes, which ultimately is reflected in the price of the product.

Furthermore, strict packaging regulations are now in effect which require beverage packing companies to adhere a hermetic seal on the outlet port of the container in certain instances. Many liquids packaged in containers or bottles are susceptible to bacterial growth. Furthermore, seals are utilized as a way to ensure to the consumer of the product that the liquid contained within has not been intentionally tampered with or contaminated. Currently, there are no cap drain assemblies, which provide a vacuum relief feature, that are compatible with liquid containers having a hermetic seal flushly mounted on the mouth of the container opening.

For example, U.S. Pat. No. 5,988,448 to Foth provides a vacuum release container cap comprising a body, closure device, and seal member. The body has a liquid passage for the flow of liquid into and out of the container, and a gas passage for the flow of air back into the container. The closure device is mounted on the body for closing each of the passages and simultaneously opens the gas passage while opening the liquid passage. The seal member is mounted in the gas passage, which allows the passage of air into the container, but does not allow the passage of liquid out of the container through the gas passage. The Foth vacuum release cap has at least a couple disadvantages. First, the body and seal member comprises a two-piece assembly which translates to more expensive manufacturing and assembly costs. Second, the Foth design does not accommodate hermetically-sealed bottles.

U.S. Pat. No. 6,079,589 to Matsuyama et al. provides a drinking receptacle cover that can be removably applied to an opening of a receptacle main body. This cover has a drinking spout which can be shut off and a negative pressure relief valve. However, Matsuyama et al. has the same disadvantages as Foth, in particular, multiple parts and the inability to be installed on hermetically-sealed beverage containers. Moreover, the Matsuyama design is only compatible with wide-mouth containers. Therefore, Matsuyama has limited applications.

U.S. Pat. No. 5,048,705 to Lynd et al. discloses a bottle and drinking tube assembly for dispensing liquids. The Lynd device does provide a selectively operable vent valve in the cap to permit airflow into the bottle enabling the user to sip the liquid through the tube or to prevent liquid outflow from the bottle when the bottle is collapsed to forcibly expel liquid through the tube. However, Lynd has the same disadvantages as Foth and Matsuyama, in particular, multiple parts and the inability to be installed on hermetically-sealed beverage containers. Also, the Lynd design is only compatible with wide-mouth containers. Therefore, Lynd is also similar to Matsuyama, in that it has limited applications.

U.S. Pat. No. 5,005,737 to Rohr discloses a flexible dispensing closure having a slitted resilient valve and a flanged vent valve for vacuum build-up relief However, the Rohr device is designed to dispense creams or lotions, and is not practicable for dispensing liquids such as water or sports beverages.

U.S. Pat. No. 6,012, 596 to Oglesbee et al. discloses an adaptor cap for a fluid container which is compatible with a hermetically-sealed container. However, the Oglesbee design is adapted for medical applications and is not suited for drinking bottle applications.

It would be desirable to provide a liquid dispensing valve assembly having a vacuum release feature that overcomes the aforementioned disadvantages. In particular, it would be beneficial to provide an economical unitarily-formed one-piece base for a valve assembly which could be fastened to a bottle or container that may or may not be hermetically-sealed.

SUMMARY OF THE INVENTION

The present invention overcomes the aforementioned disadvantages by providing a liquid dispensing valve assembly that utilizes an economical unitarily-formed one-piece base which is adapted to be fastened to a bottle or container that may or may not be hermetically sealed.

There are many advantages that the present invention has over existing dispensing valve assemblies with vacuum vent relief features. A first advantage is the one-piece unitarily formed base of the dispensing valve. By providing a one piece design production and manufacturing costs are reduced significantly. This allows the vendor of the product being consumed to market their product at competitive prices while still providing a state-of-the art dispensing valve with a vacuum relief feature.

Another advantage of the present invention is that the base is adapted to accept a container that has a hermetic seal on the opening of the container. This feature will allow easy packaging of sealed containers and yet still provide a vacuum relief feature.

A first embodiment of the present invention is provided which is a liquid dispensing valve assembly having a vacuum release feature. The valve assembly is adapted to be fastened to a container opening that may or may not be hermetically sealed. The valve assembly includes a unitarily formed one-piece cylindrical base having a vertical center axis. The base includes a mounting collar having an enclosure portion connected to the mounting collar forming an inner cavity within the base. A spout is connected to the enclosure portion having an interconnected axial core substantially positioned within the spout forming an annular liquid passageway. A gas passageway is included having at least one inlet orifice located on an outer surface of the spout. The gas passageway includes at least one generally horizontally oriented radial pipe section having one end connected to the at least one inlet orifice and another end connecting to a vertically configured pipe section having an exit orifice. Furthermore, the valve assembly includes a cap having a drain port which is adapted to slip fit over the spout.

According to an aspect of the present invention, the vertically configured pipe section is aligned about the vertical center axis. According to another aspect of the present invention the pipe extension is connected to a bottom side of the axial core. According to yet another aspect of the present invention, the axial core is interconnected to an inner surface of the spout by at least one radial oriented support rib, wherein the at least one generally horizontally oriented radial pipe section is internally molded within the at least one radial oriented support rib.

Additionally, another aspect of the present invention is that the container may have a hermetic seal applied to the opening, and in such a case, the base is adapted to be fastened to the container opening having the hermetic seal applied thereto. Moreover, the exit orifice of the vertically oriented pipe section is positioned above the seal on the opening of the container when the base is secured to the container such that the hermetic seal is not punctured.

According to other aspects of the present invention, the one-piece base is formed by injection molding. Moreover, another aspect of the present invention includes the gas passageway having a T-shape. And yet another aspect of the present invention includes the at least one generally horizontally oriented radial pipe section having two opposing inlet orifices radially spaced 180 degrees apart, and connected to the vertically oriented pipe section at the center axis. According to another aspect of the present invention, the at least one generally horizontally oriented radial pipe section includes three radial pipe sections radially spaced 120 degrees apart which intersect at the center axis of the base and connect to the vertically oriented pipe section at the center axis.

Other aspects of the present invention include jetting the flow rate in the gas passageway and controlling the flow rate of the air into the container according to the number radial pipe sections defining the at least one generally horizontally oriented radial pipe section. Furthermore, another aspect of the present invention includes jetting the flow rate in the gas passageway and controlling the flow rate of the air into the container according to the diameter of the at least one generally horizontally oriented radial pipe section and the vertically oriented pipe section.

And yet other aspects of the present invention include the cap being pulled upward to an open position. And in such a position, 'simultaneously, the annular liquid passageway is opened so that liquid may be expelled from said container, and the at least one inlet orifice is unobstructed so that gas may enter the container via the gas passageway. Moreover, a further aspect of the present invention includes the cap being pushed downward to a closed position. And in such a position, simultaneously, the annular liquid passageway is closed so that liquid may not be expelled from the container, and the at least one inlet orifice is obstructed so that gas may not enter the container via the gas passageway.

In another aspect of the present invention, a fluid dispensing valve with a vacuum release feature for a liquid container is provided including a one-piece injection molded mounting base. The base includes a cylindrical mounting collar, an enclosure portion connected to a top edge of said mounting collar forming an inner cavity within the base, and a spout. The spout has a first cylindrical portion positioned above the enclosure portion and about a center axis of the base. The first cylindrical portion is connected to a top surface of the enclosure portion and has a distal dispensing tip. The spout has an inner axial core positioned within an upper portion of the first cylindrical portion forming an annular liquid passageway. The core is fastened to an inner radial surface of the first cylindrical portion with radial oriented support ribs, wherein liquid flows from the inner cavity though the annular liquid passageway and exits from an annular opening at the dispensing tip. A gas passageway is provided separate from the annular passageway, having at least one inlet orifice located on an outer surface of the first cylindrical portion. A radial pipe section of the gas passageway is integrally formed within at least one of the radial ribs and within the inner axial core of the spout. The gas passageway is further routed through a pipe extension having an exit orifice. The pipe extension is attached to a bottom side of the core along the center axis of the base and projects downward into the inner cavity. A cap is also included having a second cylindrical portion and top portion with a drain port. The cap is slip-fit over the spout and adapted to be pulled upward to simultaneously open the liquid and gas passageways. The cap is also adapted to be pushed downward to close the liquid and gas passageways simultaneously, wherein the core protrudes through the drain port to prevent liquid flow when the cap is pushed downward, and wherein an inner radial wall of the second cylindrical portion blocks the at least one inlet orifice preventing gas flow.

According to another aspect of the present invention, the present invention further includes receiving threads on an inside surface of the mounting portion, wherein the threads are adapted to be screwed onto a threaded container top.

Another aspect of the present invention provides a hermetically-sealed fluid container in combination with a liquid dispensing valve having a vacuum release feature for a liquid container. This aspect of the present invention includes a liquid container having an outlet with a hermetic seal attached flush with said outlet and a liquid dispensing valve, with a vacuum release feature, fastened to the liquid container outlet.

And finally, a further aspect of the present invention is a process for providing a hermetically-sealed container with a dispensing valve having a vacuum release feature. The process includes forming a one-piece base with a center axis by injection molding. The base is adapted to receive an opening of a container having a hermetic seal, and includes a mounting collar, an enclosure portion connected to the mounting collar forming an inner cavity within said base, a spout connected to the enclosure portion having an interconnected axial core substantially positioned within the spout forming an annular liquid passageway, and a gas passageway having at least one inlet orifice located on an outer surface of the spout, the gas passageway including at least one horizontally oriented radial pipe section having one end connected to the at least one inlet orifice and another end connecting to a vertically oriented pipe extension having an exit orifice. The process further includes slip fitting a cap having a drain port over the spout, installing a hermetic seal on the opening of the container, and fastening the mounting collar to the opening of the container without puncturing the hermetic seal.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE PRESENT INVENTION

Figure 1:
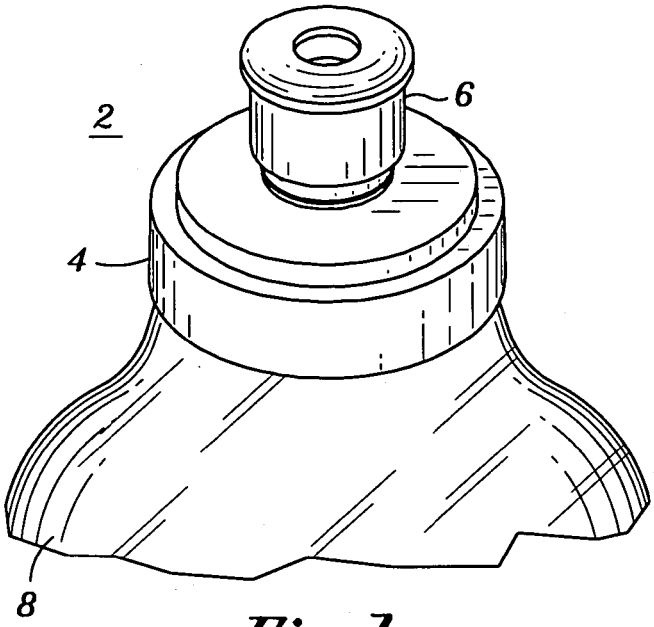
FIG. 1 shows a first exemplary embodiment of the dispensing valve assembly installed onto the mouth of a liquid container.
Figure 2:
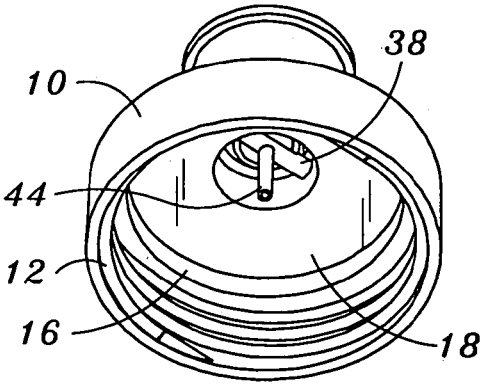
FIG. 2 is a bottom perspective view of the first exemplary embodiment of the dispensing valve assembly.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1—5B illustrate a first exemplary embodiment of a fluid dispensing valve assembly 2 which is adapted to be fastened onto a liquid container or bottle 8. In particular, the instant embodiment of valve 2 is designed to be fastened to a bottle 8 having a wide opening or mouth 9, for example, a sports drink or water bottle. Dispensing valve 2 is a two-part assembly (see FIG. 3), which includes a one-piece injected molded mounting base 4 and cap 6. Initially, it is observed that cap 6 and base 4 are radially oriented about center axis 24. It is noteworthy to mention that the design of base 4 is intentionally configured so that it may be manufactured as a unitary piece utilizing a single injection molding step. By providing a base which is unitarily formed, substantial savings may be realized with respect to production costs. Both base 4 and cap 6 may be formed from materials well known in the art for manufacturing similar dispensing caps, such as plastic. A detailed description of base 4 and cap 6 is now provided below.

Base 4 is best illustrated in FIGS. 2 through 5. A cylindrical mounting collar 10 is utilized to fasten base 4 to container opening or mouth 9, which in the instant embodiment, has mounting threads 13 formed around the mouth of the container. Therefore, the inner perimeter of mounting collar 10 utilizes receiving threads 12 which are adapted to be screwed onto the mounting threads 13 formed on the exterior perimeter of container mouth 9. It is noted that other embodiments of the present invention may have mounting collars 10 which may be adapted to be secured to container openings which utilize other various forms of securing features known in the art, such as fastening ribs which are snapped over each other. The height of the collar 10 should conform to the type of fastening mechanism utilized on container 8. For instance, in the instant embodiment, the height of collar 10 is proportional to the amount of threads required to securely fasten base 4 to the container opening.

An inner radial wall 16 projects perpendicularly inward from the top of collar 10 such that it terminates on top of the upper rim edge of container opening 9. Radial wall 16 is provided to ensure that a proper seal is formed between the upper rim edge of container opening 9 and the lower surface of radial wall 16. A vertical wall 17 projects upwardly from the upper inner edge of radial wall 16 and an upper enclosure wall 26 projects radially inward from the top edge of vertical wall 17 to define an inner upper cavity 18. In the instant embodiment, upper enclosure wall 26 has a slightly domed curvature.

Figure 5A:
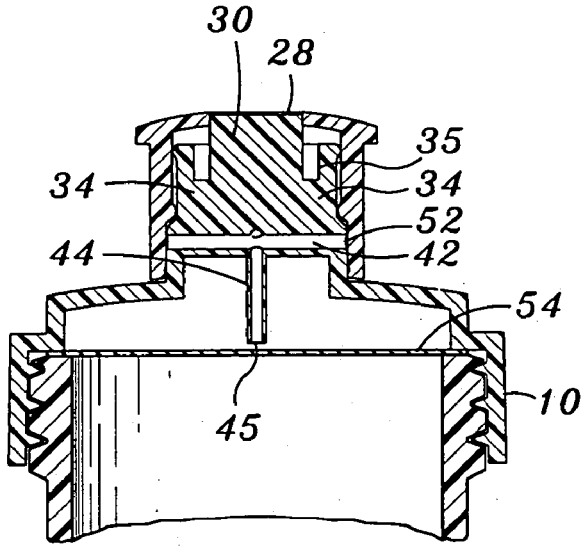
FIG. 5A is a cross-sectional view of the first exemplary embodiment of the dispensing valve assembly in a closed state taken along section line 5—5 from FIG. 3, and furthermore, depicting a hermetic seal on the liquid container.
Figure 5B:
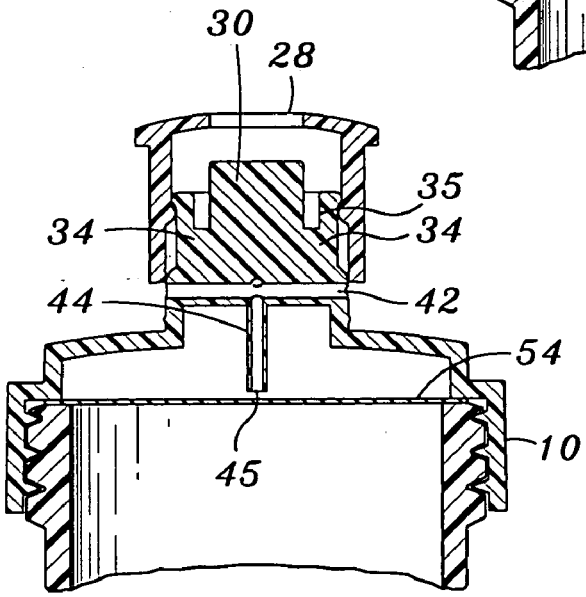
FIG. 5B is a cross-sectional view of the first exemplary embodiment of the dispensing valve assembly in a open state taken along section line 5—5 from FIG. 3, and furthermore, depicting a hermetic seal on the liquid container.

Furthermore, one aspect of the present invention includes a feature in which base 4 may be fastened onto container 8 when container opening 9 is sealed with hermetic seal 54 as illustrated in FIGS. 5A and 5B. Exit orifice 45 of vertical pipe section 44 terminates above hermetic seal 54 so that seal 54 is not punctured when base 4 is fully screwed onto container opening 9. As a result, the integrity of hermetic seal 54 is maintained until the user of the container unscrews base 4 from container 8 and removes seal 54. This feature will be further described later within the specification.

The following paragraph now describes the spout 20 which is at least composed of lower cylindrical portion 22, upper cylindrical portion 21 and inner axial core 30. Lower cylindrical portion 22 is connected to the top surface of upper enclosure wall 26. At about halfway up on spout 20, an inward offset 19 is provided which connects to upper cylindrical portion 21 of spout 20. A retaining lip 33, which is utilized to retain cap 6, is formed about the most upper edge of cylindrical portion 21.

An inner axial core 30 is substantially concentrically positioned within upper cylindrical portion 21 forming an annular liquid passageway 32 which has an upper annular opening 36. Inner axial core 30 terminates slightly downward beyond inward offset 19 which forms a lower spout cavity 23. Inner core 30 is formed such that it has a distal dispensing tip 28 which protrudes upwardly above retaining lip 33 of upper cylindrical portion 21. Inner core 30 is able to be concentrically positioned and supported within spout 20 by utilizing radial oriented support ribs 34 (see FIGS. 5A–B). FIGS. 5A–B clearly depict radial oriented support ribs 34 which attach to the inner surface of upper cylindrical portion 21, the inner surface of inward offset 19, and the uppermost inner surface of lower cylindrical portion 22.

A first embodiment of gas passageway 38 which is utilized as a path to relieve vacuum buildup in container or bottle 8 will now be described. As seen in FIGS. 2 through 8, gas passageway 38 is generally T-shaped (see FIGS. 3 and 6; shown in hidden lines). Gas passageway 38 includes a generally horizontal radial pipe section 42 having opposing inlet orifices 40 which intersect center axis 24. Radial pipe section 42 intersects and tees into a downwardly projecting vertical pipe section 44 which is coincident with center axis 24. In the instant embodiment, radial pipe section 42 is formed within radial support ribs 34 as shown in FIG. 5. Therefore, only two radial oriented ribs 34 are utilized to concentrically support core 30 within spout 20. Another aspect of the instant gas passageway embodiment is that vertical pipe section 44 has a distal exit orifice 45 which terminates slightly above a planar surface defined by the upper rim of the mouth 9 of bottle 8. The feature is incorporated in base 4 such that when base 4 is installed the mouth 9 of a bottle 8 having a hermetic seal 54 applied, that the distal exit orifice 45 of vertical pipe section 44 will not puncture hermetic seal 54.

Figure 3:
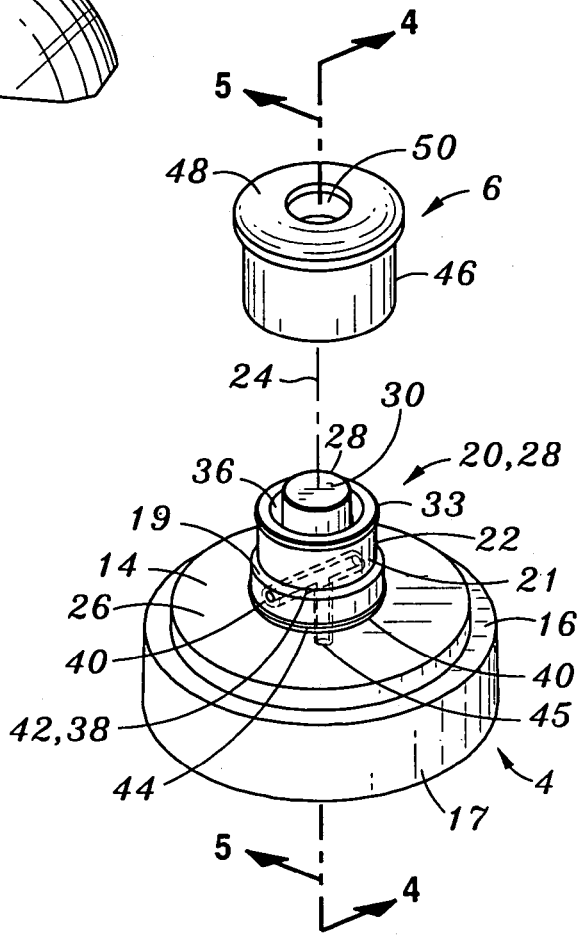
FIG. 3 is an exploded view of the first exemplary embodiment of the dispensing valve assembly.

FIGS. 3, 4, and 5A–B depict cap 6 and illustrate cap 6 installed onto spout 20 of base 4. As shown in FIG. 3, cap 6 is includes a cylindrical section 46 having an annular top portion 48 with a drain port 50 in which liquid may be dispensed. Formed on the inside surface of cylindrical section 46 is a protruding rib 49 which is utilized as a retaining feature. Cap 6 is slip fit onto spout 20 such that it may be positioned in a fully closed state or a fully opened state. Retaining lip 33 is utilized to retain cap 6 by stopping protruding rib 49. Other embodiments of retaining features known in the art such as annular ribs and receiving grooves may also be utilized for retaining and sealing cap 6 about spout 20.

Figure 4:
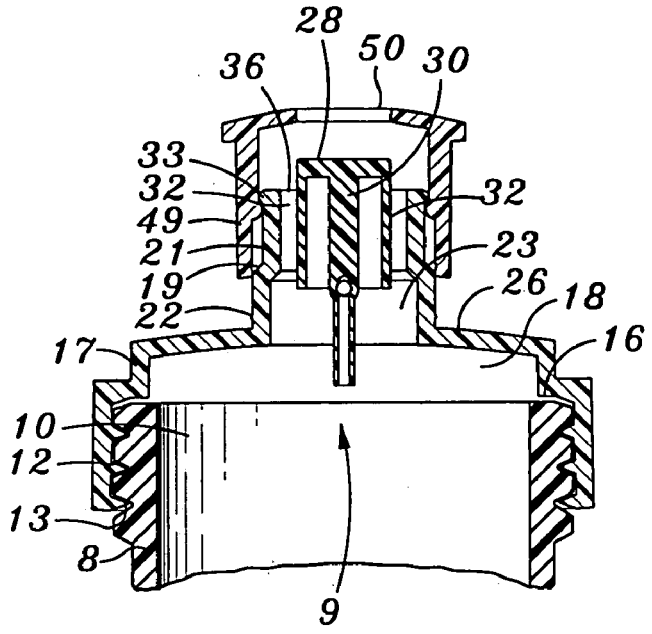
FIG. 4 is a cross-sectional view of the first exemplary embodiment of the dispensing valve assembly in an opened state taken along section line 4—4 from FIG. 3.

FIG. 4 is a cross-sectional view of liquid dispensing valve 2 (taken along section line 4—4 from FIG. 3) when cap 6 is pulled up in an open position. This cross-sectional view illustrates the internal structure of valve 2 and the flow path that liquid follows when being dispersed from bottle 8. The flow path begins at mouth 9 of the bottle 8, continues through inner cavity 18 formed by collar 10 and enclosure top surface 26, continues through lower spout cavity 23, then continues through annular liquid passageway 32, the liquid exits through annular opening 36, and furthermore flows through a cavity defined by an internal upper portion of cap 6 and inner axial core 30, and finally is dispersed from drain port 50. Therefore, when cap 6 is in an open configuration as depicted in FIG. 4, liquid will flow freely out of container 8.

FIG. 5A is a cross-sectional view of the first exemplary embodiment of the dispensing valve 2 in a closed state taken along section line 5—5 from FIG. 3, and furthermore, FIG. 5A depicts a hermetic seal on the liquid container. It is evident that the aforementioned flow described in the previous paragraph is closed or inhibited by cap 6. In particular, distal dispensing tip 28 is received into drain port 50 once cap 6 has been pushed down over spout 20. Cap 6 is stopped when protruding rib 49 engages inward offset 19 of spout 20. Furthermore, simultaneously, as the liquid flow path is inhibited, the vacuum relief path establish through gas passageway 38 is closed. In particular, inlet orifices 40 are blocked and closed off by the inner surface of cylindrical section 46 of cap 6. FIG. 5A also illustrates a hermetic seal 54 which has not been punctured. Thus, liquid is not even capable of flowing into dispensing valve 2 until hermetic seal 54 is punctured or removed.

FIG. 5B is a cross-sectional view of the first exemplary embodiment of the dispensing valve 2 in a open state taken along section line 5—5 from FIG. 3, and furthermore, FIG. 5B depicts a hermetic seal 54 applied to the mouth 9 of the bottle 8. In this circumstance, it is evident that a flow path similar to that describe above with respect to FIG. 4 is established, except for the hermetic seal 54 still being in place. Furthermore, FIG. 5B best illustrates how a flow path is established through gas passageway 38. In particular, since the cylindrical section 46 of cap 6 has been raised above inlet orifices 40, air may flow into radial pipe sections 42 and through downwardly projecting vertical pipe section 44. Thus, it is shown, that when a fluid flow path is established, and vacuum relief path is also simultaneously established. Furthermore, it is shown, that when the fluid path is inhibited by cap 6, the vacuum relief path 6 is also simultaneously inhibited.

Figure 6:
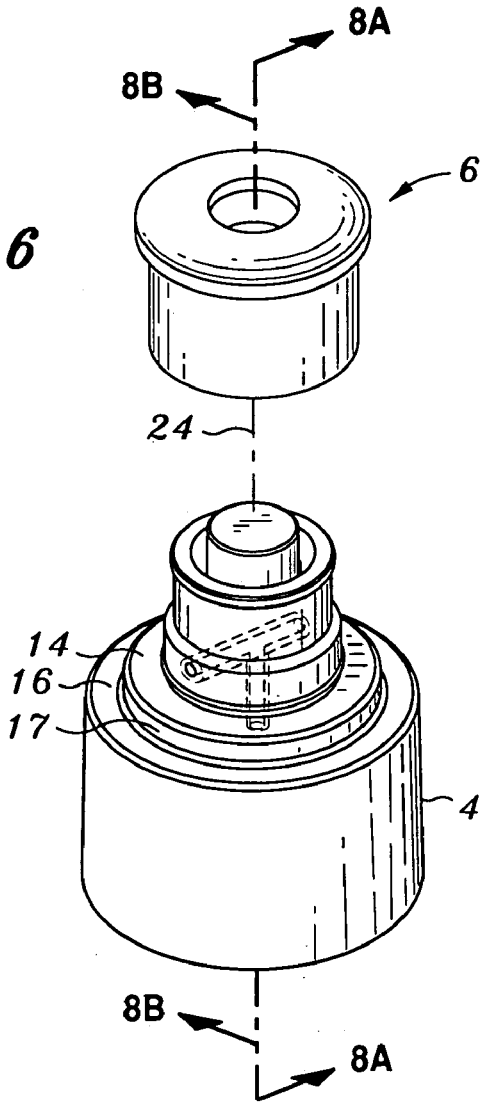
FIG. 6 is an exploded view of a second exemplary embodiment of the dispensing valve assembly.
Figure 7:
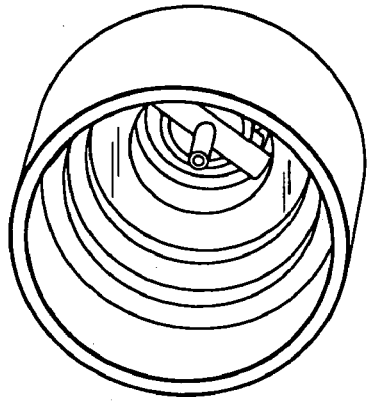
FIG. 7 is a bottom perspective view of the second exemplary embodiment of the dispensing valve assembly.
Figure 8A:
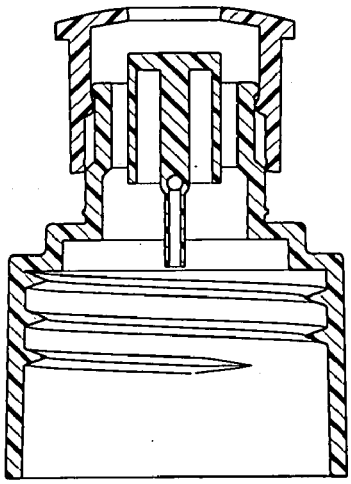
FIG. 8A is a cross-sectional view of the second exemplary embodiment of the dispensing valve assembly in an opened state taken along section line 8A—8A from FIG. 6.
Figure 8B:
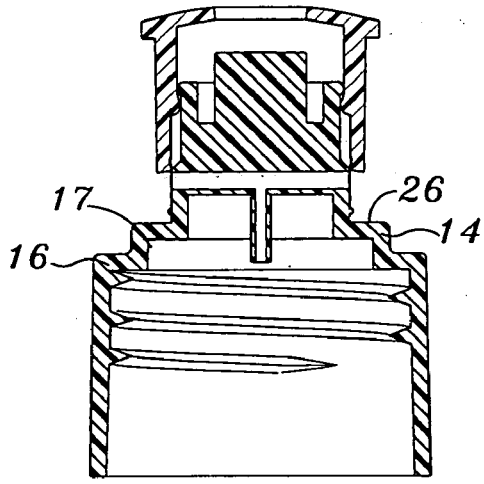
FIG. 8B is a cross-sectional view of the second exemplary embodiment of the dispensing valve assembly in an opened state taken along section line 8B—8B from FIG. 6.

FIGS. 6–8B provide a second embodiment of dispensing valve 2 which is configured to be fastened to a container 8 having a narrow opening or mouth 9, for example, a spring water bottle or soda beverage. FIG. 6 is an exploded view of the second embodiment of liquid dispensing valve 2, including base 4 and cap 6 centered about center axis 24. FIG. 7 is a bottom perspective view of the second exemplary embodiment of dispensing valve 2. FIG. 8A is a cross-sectional view of the second exemplary embodiment of dispensing valve 2 taken along section line 8A—8A from FIG. 6. And, FIG. 8B is a cross-sectional view of the second exemplary embodiment of dispensing valve 2 taken along section line 8B—8B from FIG. 6.

In the aforementioned embodiment, the overall diameter of base 4 is narrower than the first embodiment resulting in a smaller enclosure portion 14. Otherwise, the features of the second embodiment are similar to the features of the first embodiment, and therefore, discussion of the details of the aforementioned second embodiment's features is not necessary.

Figure 9:
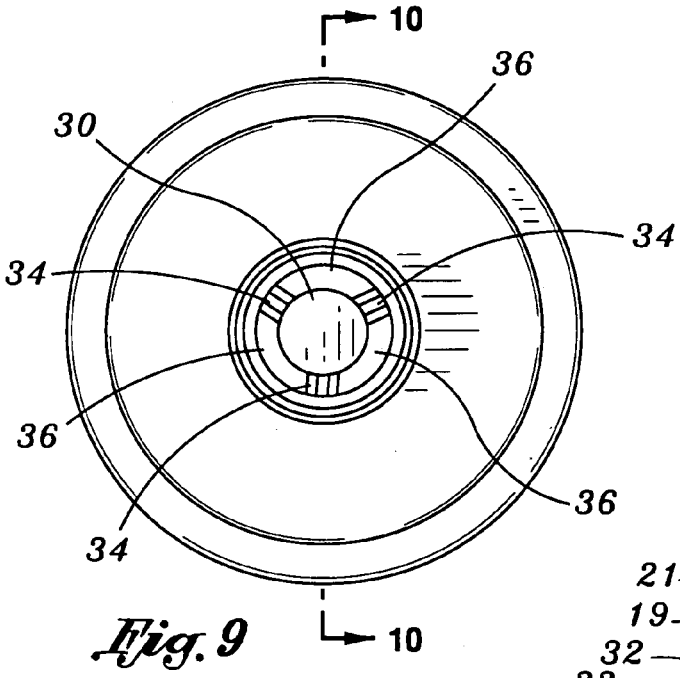
FIG. 9 is a top view of the base of a third exemplary embodiment of the dispensing valve assembly with the cap removed.

FIGS. 9 through 12 depict an alternative embodiment of gas passageway 38. In this embodiment, gas passageway 38 is integrally formed with three radial ribs 34 so that three radial pipe sections 42 (see FIG. 12) may be utilized to increase the flow of gas into container 8 as the vacuum is being released. FIG. 9 is a top view of the instant exemplary embodiment of dispensing valve 2 with cap 6 removed. From this perspective, annular opening 36 is clearly visible. Also, the top view reveals three radial oriented support ribs 34 each spaced about 120 degrees apart concentrically supporting core 30 within spout 20. It is further noted that radial pipe section 42 is integrally molded within each radial oriented support rib 34.

Figure 10:
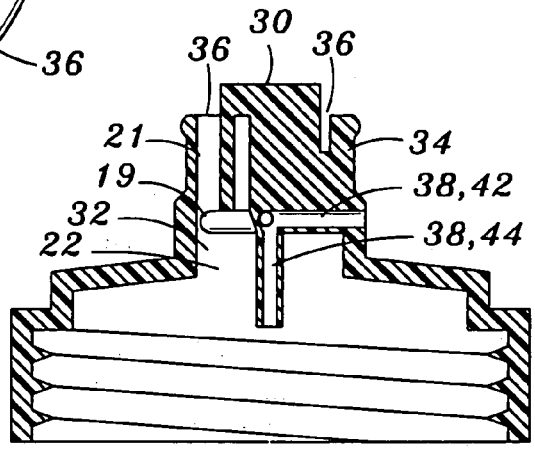
FIG. 10 is a cross-sectional view of the base of the third exemplary embodiment of the dispensing valve assembly taken along section line 10—10 from FIG. 9.
Figure 11:
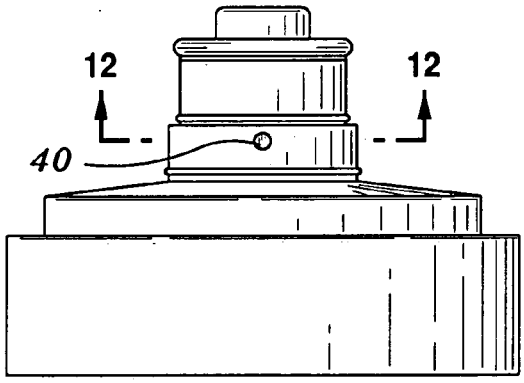
FIG. 11 is a side view of the base of the third exemplary embodiment of the dispensing valve assembly.

FIG. 10 is a cross-sectional view of the exemplary embodiment base 4 which utilizes three radial oriented support ribs 34 (taken along section line 10—10 from FIG. 9) having a radial pipe section 42 integrally molded within each radial oriented support rib 34. Moreover, this view shows annular liquid passageway 32, annular opening 36, and inner axial core 30 which is connected to the inner surface of upper cylindrical portion 21, the inner surface of inward offset 19, and the uppermost inner surface of lower cylindrical portion 22.

Figure 12:
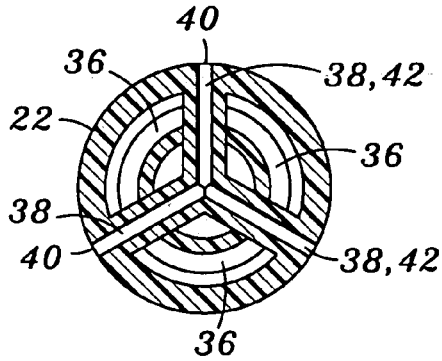
FIG. 12 is a cross-sectional view of the spout of the base of the third exemplary embodiment of the dispensing valve assembly taken along line 12—12 from FIG. 12.

FIG. 12 is the cross-sectional view of spout 20 (taken along section line 12—12 from FIG. 11) which further illustrates the exemplary embodiment of base 4 which utilizes three radial oriented support ribs. 34 having a radial pipe section 42 integrally molded within each radial oriented support rib 34. This cross-sectional view clearly shows three radial oriented support ribs 34 spaced about 120 degrees which are connected to the inner surface of upper cylindrical portion 21, the inner surface of inward offset 19, and the uppermost inner surface of lower cylindrical portion 22. It further shows support ribs 34 connecting to inner axial core 30 such that core 30 is concentrically positioned within spout 20. Also, shown are three radial pipe sections 42 integrally formed with support ribs 34 converging at center axis 24, each of which has an affiliated inlet orifice 40.

As can be seen from the different gas passageway embodiments already discussed, numerous embodiments of gas passageway 38 may be provided. In particular, the number of radial pipe sections 42 which converge at center axis 24 and tie into downwardly projecting vertical pipe section 44 may vary. For instance, an embodiment of gas passageway 38 may be provided which utilizes only one radial pipe section 42. Or alternative gas passageway 38 embodiments may be provided which utilize four or five radial pipe sections 42. It also noted, that the diameters of radial pipe sections 42 may vary, as well as the diameter of vertical pipe section 44.

Parameters, such as the number of radial pipe sections 42 and diameter of the radial pipe sections 42 and vertical pipe section 44, may be varied or selected accordingly to provide a liquid dispensing valve 2 that has "tuned" or "jetted" characteristics for a specific bottle or container shape which has specific characteristics of its own, such as liquid capacity, flow rate, vacuum strength, open cavity space, etc. In particular, this is achieved by determining how many radial pipe sections 42 are required to achieve an optimum gas passageway 32 flow rate without allowing an excess of gas flow into annular liquid passageway 32. By comparing the total length of gas passageway 38 to the inner diameter of gas passageway 38 a ratio may be obtained. The preferred ratio is one of which is great enough to ensure unrestricted air flow into bottle 8 yet still prevent gas from flowing into annular liquid passageway 32.

The following section now discusses the functionality of dispensing valve 2. As noted previously, dispensing valve 2 is adapted to be attached to bottles 8 that either have or do not have hermetically sealed mouths 9. As is shown in FIGS. 4 through 5B, there are no components which protrude into the hermetic seal 54. To dispense liquid from liquid container 8, seal 54 would first have to be removed if it had been installed when the liquid was originally filled and packaged into container 8. This entails removing base 4 of dispensing valve 2 from opening 9 of container 8, removing seal 54, and then reinstalling base 4 of dispensing valve 2 onto the opening or mouth 9 of container 8.

To initiate flow of liquid from container 8 out of spout 20, the user should pull cap 6 upwards as shown in FIGS. 4, 5B, 8A and 8B. When cap 6 is in the open position, flow paths are simultaneously created for both the liquid medium and the vacuum release feature. As previously discussed, the flow path begins at mouth 9 of the bottle 8, continues through inner cavity 18 formed by collar 10 and enclosure top surface 26, continues through lower spout cavity 23, then continues through annular liquid passageway 32, the liquid exits through annular opening 36, and furthermore flows through a cavity defined by an internal upper portion of cap 6 and inner axial core 30, and finally liquid is dispersed from drain port 50.

Typically, as liquid is evacuated from a container 8, a vacuum will begin to form. This normally becomes visibly evident when the bottle or container 8 is squeezed and the container stays deformed or compressed. However, in the case of the present invention, since cylindrical section 46 of cap 6 is not covering gas passageway 38 inlet orifices 40, air will be allowed to back flow through gas passageway 38 to equalize the pressure inside container 8, and therefore, prevent an undesired vacuum effect.

To close container 8 to stop flow of liquid out of spout 20, the user should push cap 6 downwards as shown in FIG. 5A. When cap 6 is closed, distal dispensing tip 28 is received into drain port 50. Cap 6 is stopped when protruding rib 49 engages inward offset 19 of spout 20. Furthermore, simultaneously, as the liquid flow path is inhibited, the vacuum relief path establish through gas passageway 38 is closed. In particular, inlet orifices 40 are blocked and closed off by the inner surface of cylindrical section 46 of cap 6.

Features of the present invention may also be incorporated into other cap designs such as ergonomic caps in which a valve assembly is twisted open instead of a cap being pulled open.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and uses such are within the scope of the appended claims.

What is claimed:

1. A liquid dispensing valve assembly with a vacuum release feature, said valve assembly adapted to be fastened to a container opening, said valve assembly comprising:

a unitarily formed one-piece cylindrical base having a vertical center axis comprising, a mounting collar, an enclosure portion connected to said mounting collar forming an inner cavity within said base, a spout connected to said enclosure portion having an interconnected axial core substantially positioned within said spout forming an annular liquid passageway, and a gas passageway having at least one inlet orifice located on an outer surface of said spout, said gas passageway comprising at least one generally horizontally oriented radial pipe section having one end connected to said at least one inlet orifice and another end connecting to a vertically configured pipe section having an exit orifice; and a cap having a drain port, said cap adapted to slip fit over said spout.

2. The dispensing valve assembly according to claim 1, said vertically configured pipe section aligned about the vertical center axis.

3. The dispensing valve assembly according to claim 1, said pipe extension connected to a bottom side of said axial core.

4. The dispensing valve assembly according to claim 1, said axial core interconnected to an inner surface of said spout by at least one radial oriented support rib, said at least one generally horizontally oriented radial pipe section being internally molded within said, at least one radial oriented support rib.

5. The dispensing valve assembly according to claim 1, wherein the container has a hermetic seal applied to the opening, wherein said base is adapted to be fastened to the container opening having the hermetic seal applied thereto, and wherein said exit orifice of said vertically oriented pipe section is positioned above the seal on the opening of the container when said base is secured to the container such that the hermetic seal is not punctured.

6. The dispensing valve assembly according to claim 1, wherein said one-piece base is formed by injection molding.

7. The dispensing valve assembly according to claim 1, said gas passageway having a T-shape.

8. The dispensing valve according to claim 1, said at least one generally horizontally oriented radial pipe section having two opposing inlet orifices radially spaced 180 degrees apart, and connected to said vertically oriented pipe section at the center axis.

9. The dispensing valve assembly according to claim 1, said at least one generally horizontally oriented radial pipe section comprising three radial pipe sections radially spaced 120 degrees apart which intersect at the center axis of said base and connect to said vertically oriented pipe section at the center axis.

10. The dispensing valve assembly according to claim 1, wherein said gas passageway may be jetted and the flow rate of the air into the container is operative to be controlled according to the number radial pipe sections comprising the at least one generally horizontally oriented radial pipe section.

11. The dispensing valve assembly according to claim 1, wherein said gas passageway is operative to be jetted and the flow rate of the air into the container may be controlled according to the diameter of the at least one generally horizontally oriented radial pipe section and said vertically oriented pipe section.

12. The dispensing valve assembly according to claim 1, wherein when said cap is pulled upward to an open position, simultaneously, (1) said annular liquid passageway is opened so that liquid may be expelled from said container, and (2) said at least one inlet orifice is unobstructed so that gas is allowed to enter the container via said gas passageway.

13. The dispensing valve assembly according to claim 1, wherein when said cap is pushed downward to a closed position, simultaneously, (1) said annular liquid passageway is closed so that liquid may not be expelled from said container, and (2) said at least one inlet orifice is obstructed so that gas is not allowed enter the container via said gas passageway.

14. A liquid dispensing valve with a vacuum release feature for a liquid container comprising:

a one-piece injection molded mounting base, said base comprising, a cylindrical mounting collar;

an enclosure portion connected to a top edge of said mounting collar forming an inner cavity within said base;

a spout having a first cylindrical portion positioned above said enclosure portion and about a center axis of said base, said first cylindrical portion connected to a top surface of said enclosure portion, said first cylindrical portion having a distal dispensing tip, said spout having an inner axial core positioned within an upper portion of said first cylindrical portion forming an annular liquid passageway, said core fastened to an inner radial surface of said first cylindrical portion with radial oriented support ribs, wherein liquid flows from said inner cavity though said annular liquid passageway and exits from an annular opening at said dispensing tip;

a gas passageway separate from said annular passageway, having at least one inlet orifice located on an outer surface of said first cylindrical portion, a radial pipe section of said gas passageway being integrally formed within at least one of said radial ribs and within said inner axial core of said spout, said gas passageway further routed through a pipe extension having an exit orifice, said pipe extension attached to a bottom side of said core along the center axis of said base and projecting downward into said inner cavity; and a cap having a second cylindrical portion and top portion with a drain port, said cap slip-fit over said spout and adapted to be pulled upward to simultaneously open said liquid and gas passageways, adapted to be pushed downward to close said liquid and gas passageways simultaneously, wherein said core protrudes through said drain port to prevent liquid flow when said cap is pushed downward, and wherein an inner radial wall of said second cylindrical portion blocks the at least one inlet orifice preventing gas flow.

15. The dispensing valve according to claim 14, said base adapted to accept a hermetically-sealed container opening without puncturing the seal.

16. The dispensing valve according to claim 14, further comprising receiving threads on an inside surface of said mounting portion, said threads adapted to be screwed onto a threaded container top.

17. The dispensing valve according to claim 14, wherein said section of said gas passageway integrally formed within at least one of said radial ribs comprises a radial pipe section, forming a T-shaped gas passageway with said pipe extension having two opposing inlet orifices radially spaced 180 degrees apart.

18. The dispensing valve according to claim 14, wherein said radial pipe section is integrally formed within at least one of said radial ribs comprises three path sections radially spaced 120 degrees apart.

19. The dispensing valve according to claim 14, wherein a ratio, comparing a total length of the gas passageway to an inner diameter of the gas passageway, wherein the ratio is great enough to ensure unrestricted air flow into the bottle yet prevent gas from flowing into the annular liquid passageway.

20. A hermetically-sealed liquid container in combination with a fluid dispensing valve having a vacuum release feature for a liquid container comprising:

a liquid container having an outlet with a hermetic seal attached flush with said outlet;

a liquid dispensing valve, with a vacuum release feature, fastened to said fluid container outlet, said valve comprising, a one piece injection molded mounting base, said base comprising, a cylindrical mounting collar;

an enclosure portion connected to a top edge of said mounting collar forming an inner cavity within said base;

a spout having a first cylindrical portion positioned above said enclosure portion and about a center axis of said base, said first cylindrical portion connected to a top surface of said enclosure portion, said first cylindrical portion having a distal dispensing tip, said spout having an inner axial core positioned within an upper portion of said first cylindrical portion forming an annular liquid passageway, said core fastened to an inner radial surface of said first cylindrical portion with radial oriented support ribs, wherein liquid flows from said inner cavity though said annular liquid passageway and exits from an annular opening at said dispensing tip;

a gas passageway separate from said annular passageway, having at least one inlet orifice located on an outer surface of said first cylindrical portion, a section of said gas passageway being integrally formed within at least one of said radial ribs and within said inner axial core of said spout, said gas passageway further routed through a pipe extension having an exit orifice, said pipe extension attached to a bottom side of said core along the center axis of said base and projecting downward into said inner cavity, wherein said exit orifice of said pipe extension is located above said hermetic seal on said outlet of said container therefore preventing puncture of said hermetic seal when said mounting base is installed on said container; and a cap having a second cylindrical portion and top portion with a drain port, said cap slip-fit over said spout and adapted to be pulled upward to simultaneously open said liquid and gas passageways, adapted to be pushed downward to close said liquid and gas passageways simultaneously, wherein said core protrudes through said drain port to prevent liquid flow when said cap is pushed downward, and wherein an inner radial wall of said second cylindrical portion blocks the at least one inlet orifice preventing gas flow.

21. The A unitarily formed one-piece cylindrical base comprising:

a mounting collar;

an enclosure portion connected to said mounting collar forming an inner cavity within said base;

a spout connected to said enclosure portion having an interconnected axial core substantially positioned within said spout forming an annular liquid passageway; and a gas passageway having at least one inlet orifice located on an outer surface of said spout, said gas passageway comprising at least one generally horizontally oriented radial pipe section having one end connected to said at least one inlet orifice and another end connecting to a vertically configured pipe section having an exit orifice, wherein: said vertically configured pipe section aligned about the vertical center axis: and said at least one generally horizontally oriented radial pipe section having two opposing inlet orifices radially spaced 180 degrees apart, and connected to said vertically oriented pipe section at the center axis.

22. The base according to claim 21, said at least one generally horizontally oriented radial pipe section comprising three radial pipe sections radially spaced 120 degrees apart which intersect at the center axis of said base and connect to said vertically oriented pipe section at the center axis.

* * * * *